US006019943A

United States Patent [19]

Buscemi et al.

[11] Patent Number: 6,019,943

[45] Date of Patent: Feb. 1, 2000

[54] DIFFUSION BARRIERS FOR PREVENTING HIGH TEMPERATURE HYDROGEN ATTACK

[75] Inventors: Charles D. Buscemi, San Francisco; John V. Heyse, Crockett, both of Calif.

[73] Assignee: Chevron Chemical Company, San Ramon, Calif.

[21] Appl. No.: 08/696,672

[22] Filed: Aug. 14, 1996

Related U.S. Application Data

[60] Provisional application No. 60/002,971, Aug. 18, 1995.

[51] Int. Cl.[7] ..... C23F 11/00

[52] U.S. Cl. ..... 422/8; 422/7; 423/DIG. 8

[58] Field of Search ..... 422/7, 8; 423/DIG. 8

[56] References Cited

U.S. PATENT DOCUMENTS 5,405,525 4/1995 Heyse et al. ..... 208/133
5,406,014 4/1995 Heyse et al. ..... 585/444

FOREIGN PATENT DOCUMENTS

WO 92/15653 9/1992 WIPO .

OTHER PUBLICATIONS

C.M. Cooper, "Hydrogen Attack", *Hydrocarbon Processing*, Aug., 1972, pp. 69–70.

C.L. Chen, P.Y. Lee, J.K. Wu, D.J. Chiou, C.Y. Chu and J.Y. Lin, "The Use of Zinc And Tin Coatings And Chemical Addtives For Preventing Hydrogen Embrittlement In Steel", *Corrosion Prevention & Control*, pp. 71–74, Jun., 1993.

"Corrosion in the Petrochemical Industry", edited by Linda Garverick, *ASM International*, pp. 59–63 and pp. 330–332, Dec., 1994.

S.S. Chatterjee, B.G. Ateya, and H.W. Pickering, "Effect of Electrodeposited Metals on the Permeation of Hydrogen through Iron Membranes", *Mettallurgical Transactions*, vol. 9A, pp. 389–395, Mar., 1978.

M. Zamanzadeh, A. Allam, C. Kato, B. Ateya, and H.W. Pickering, "Hydrogen Absorption during Electrodeposition and Hydrogen Charging of Sn and Cd Coatings on Iron", J. Elect. Chem. Soc., pp. 284–289, vol. 129, No. 2.

"Eight Forms of Corrosion", pp. 108–115, "High–Temperature Metal–Gas Reactions", pp. 367–373, Sections from *Corrosion Engineering*, text by M.G. Fonatana and D. Greene.

*Primary Examiner*—E. Leigh McKane
*Attorney, Agent, or Firm*—Pennie & Edmonds LLP

[57] ABSTRACT

A method of protecting carbon and low-alloy steels from high temperature hydrogen attack. A carbon or low-alloy steel portion of a reactor system that is to be contacted with high pressure hydrogen at elevated temperatures is provided with an intermetallic, diffusion barrier layer that reduces the rate of hydrogen attack at least ten-fold compared to the steel portion without the diffusion barrier layer.

17 Claims, 3 Drawing Sheets

DIFFUSION BARRIERS FOR PREVENTING HIGH TEMPERATURE HYDROGEN ATTACK

This application claims benefit of Provisional Application 60/002,971 filed Aug. 18, 1995.

FIELD OF THE INVENTION

The present invention is a novel method of protecting carbon and low-alloy steels from hydrogen attack. The method reduces hydrogen attack and fissuring in steel that is used in gaseous, high-temperature hydrogen environments by providing an intermetallic diffusion barrier layer to the steel surface.

BACKGROUND OF THE INVENTION

There are an enormous range of problems associated with steels that are all superficially designated as "corrosion". And there are hundreds if not thousands of different solutions to these various corrosion problems. These various types of corrosion each have different mechanisms and sometimes different consequences. Given the different mechanisms, the solution to one corrosion problem is generally not applicable to another. In other words, it is difficult to predict with any reasonable expectation of success whether a solution effective for one corrosion problem is likely to be effective for another, different corrosion problem.

The present invention is related to one specific type of corrosion—high-temperature hydrogen attack of carbon and low-alloy steels. The term "hydrogen attack" is well known in the art. For example, in the book, "Corrosion in the Petrochemical Industry" edited by L. Garverick (1994), it is defined on pp. 59:

> "Hydrogen attack is a high-temperature form of hydrogen damage that occurs in carbon and low-alloy steels exposed to high-pressure hydrogen at high temperatures for extended time. Hydrogen enters the steel and reacts with carbon either in solution or as carbides to form methane gas; this may result in the formation of cracks and fissures or may simply decarburize the steel, resulting in a loss in strength of the alloy. This form of damage is temperature dependent, with a threshold temperature of approximately 200° C. (400° F.)."

Hydrogen attack is a significant problem in petroleum refineries and chemical plants. This problem is compounded in that it is difficult to monitor or observe hydrogen attack by inspection of in-place equipment. Moreover, there is an induction period before hydrogen attack occurs. Yet, failure to replace equipment that is or has suffered hydrogen attack can lead to metallurgical failure, with hydrogen and/or hydrocarbons release. This can lead to fires and even explosions.

Hydrogen attack should not be confused with other types of corrosion caused by hydrogen in different environments and under different reaction conditions. For example, hydrogen embrittlement of steel is a totally different process. It is an low-temperature, low pressure, aqueous process that starts with proton (H+) adsorption and diffusion into the interstitial spaces between the iron molecules in the steel structure. This aqueous, cathodic corrosion changes the way the steel responds to stress; after embrittlement, the steel ductility is reduced, and it may fracture rather than bend. Some proposed solutions to the problem of aqueous hydrogen embrittlement are described in Chen et al, "The Use of Zinc and Tin Coatings and Chemical Additives for Preventing Hydrogen Embrittlement in Steel", *Corrosion Prevention and Control*, June 1993, pp. 71–4.

Another type of corrosion which is unrelated to hydrogen attack is carburization. Carburization occurs in high temperature hydrocarbon environments. In mechanism, carburization is almost the opposite of hydrogen attack. Carburization is the injection of carbon into the steel. This injected carbon forms surface metal carbides, which embrittle the steel. Some solutions to this carburization problem in low sulfur reforming are described in Heyse et al., WO 92/15653. Solutions to the carburization problem in other processes are described in WO 94/15898 and WO94/15896, both to Heyse et al. Among these solutions is the use of metallic tin coatings. However, the parts of commercial process equipment where carburization and metal dusting are a concern are designed and constructed of materials such as high alloy or stainless steel. Here hydrogen attack is not a problem.

Currently, there are a wide variety of petroleum-related processes that have equipment made of carbon and low-alloy steels. Some of this in-place metallurgy is operated under conditions that can potentially result in high-temperature hydrogen attack of the steel. These processes include, for example, hydrotreating, hydrofining, hydrocracking and hydrogen production. Desulfurization and/or denitrification of hydrocarbon feeds is often the process objective. Hydrogen attack is most problematic in the hot loop, i.e., in reactors, steam generators, heat exchangers and associated piping, since both the rate of hydrogen diffusion though the steel and the thermodynamic driving force for methane formation (and therefore the rate of hydrogen attack) increase with increasing temperature.

In many instances the in-place metallurgy, that is, the carbon or low-alloy steel, was originally expected to operate safely at typical process conditions, that is, it was expected that hydrogen attack would not occur. However, it has been shown that the susceptibility of certain low-alloy steels to hydrogen attack is greater than previously believed. Today, the concerns associated with hydrogen attack of the steel have limited the operating conditions and necessitates regular inspections of the steel.

There are few commercial solutions to the problem of hydrogen attack in existing equipment. One solution is to operate at reduced severity (lower) and suffer whatever yield losses or reduced throughput is required. Another solution is to replace the carbon or low-alloy steel with a steel that is not susceptible to hydrogen attack at the reaction conditions. For example, a higher alloy steel or a stainless steel containing chromium and optionally nickel can be used. Replacing the steel is a major undertaking and can be quite costly.

As described above, a practical, effective and inexpensive solution to the hydrogen attack problem—especially for carbon and low-alloy steels already in place and in use—has long been needed. One object of the present invention is to provide such a solution.

SUMMARY OF THE INVENTION

The present invention is a method for protecting carbon and low-alloy steels from high temperature hydrogen attack and fissuring. In one embodiment, the invention comprises providing a carbon or low-alloy steel portion of a reactor system that is to be contacted with a hydrogen-containing gas at elevated temperatures with an intermetallic, diffusion barrier layer that is effective for reducing the rate of hydrogen attack.

In another embodiment, the invention is a method for protecting carbon and low-alloy steels from high temperature, high pressure, hydrogen attack and fissuring, comprising:

a) treating a carbon or low-alloy steel portion of a reactor system which is to be contacted with high pressure hydrogen, and optionally hydrocarbons, sulfur and oxygen compounds including water, with a metal component selected so that it produces an intermetallic surface diffusion barrier layer which reduces the rate of hydrogen permeation through the steel by a factor of at least 10; and b) passing high pressure hydrogen over said metal-treated steel at temperatures between about 400° F. to 1050° F. and at hydrogen pressures above 400 psig.

There are a variety of metals that produce effective intermetallic, diffusion barrier layers which protect against hydrogen attack. Preferred diffusion barrier layers are prepared from metals selected from tin, antimony, germanium, and compounds, mixtures, alloys, and intermetallic compounds thereof.

An especially preferred intermetallic, diffusion barrier layer is prepared from coatings comprising tin, or tin compounds, or tin alloys or intermetallic compounds of tin, preferably tin or tin compounds. One preferred coating is a tin paint, more preferably in the form of a reducible paint. In a preferred embodiment, an iron-stannide diffusion barrier layer is pre-formed on the steel prior to subjecting the steel to hydrogen attack conditions.

In yet another embodiment, the invention is applied to carbon and low-alloy steels already in service in a hydrogen attack environment. Here the present invention is a method for protecting carbon and low-alloy steels from high temperature hydrogen attack and fissuring, comprising:

(a) applying a metal plating, paint, cladding or other coating to a steel portion made of carbon or low-alloy steel that has been subjected to hydrogen attack conditions; and (b) forming an intermetallic, diffusion barrier layer on the steel surface by heating; thereby reducing the rate of hydrogen permeation through the steel portion by a factor of at least 10 compared to a steel portion without the barrier layer.

The steel portion is then able to withstand additional exposures to high-temperature (and also high-pressure) hydrogen, and might even withstand more severe hydrogen attack conditions.

Among other factors, the present invention is based on the discovery that a thin (e.g, less than 100 microns, preferably, between 10–40 micron) intermetallic tin layer on the surface a carbon or low-alloy steel is surprisingly effective in preventing hydrogen diffusion through to the underlying steel under high temperature hydrogen attack conditions.

DETAILED DESCRIPTION OF THE INVENTION

Figure 1:
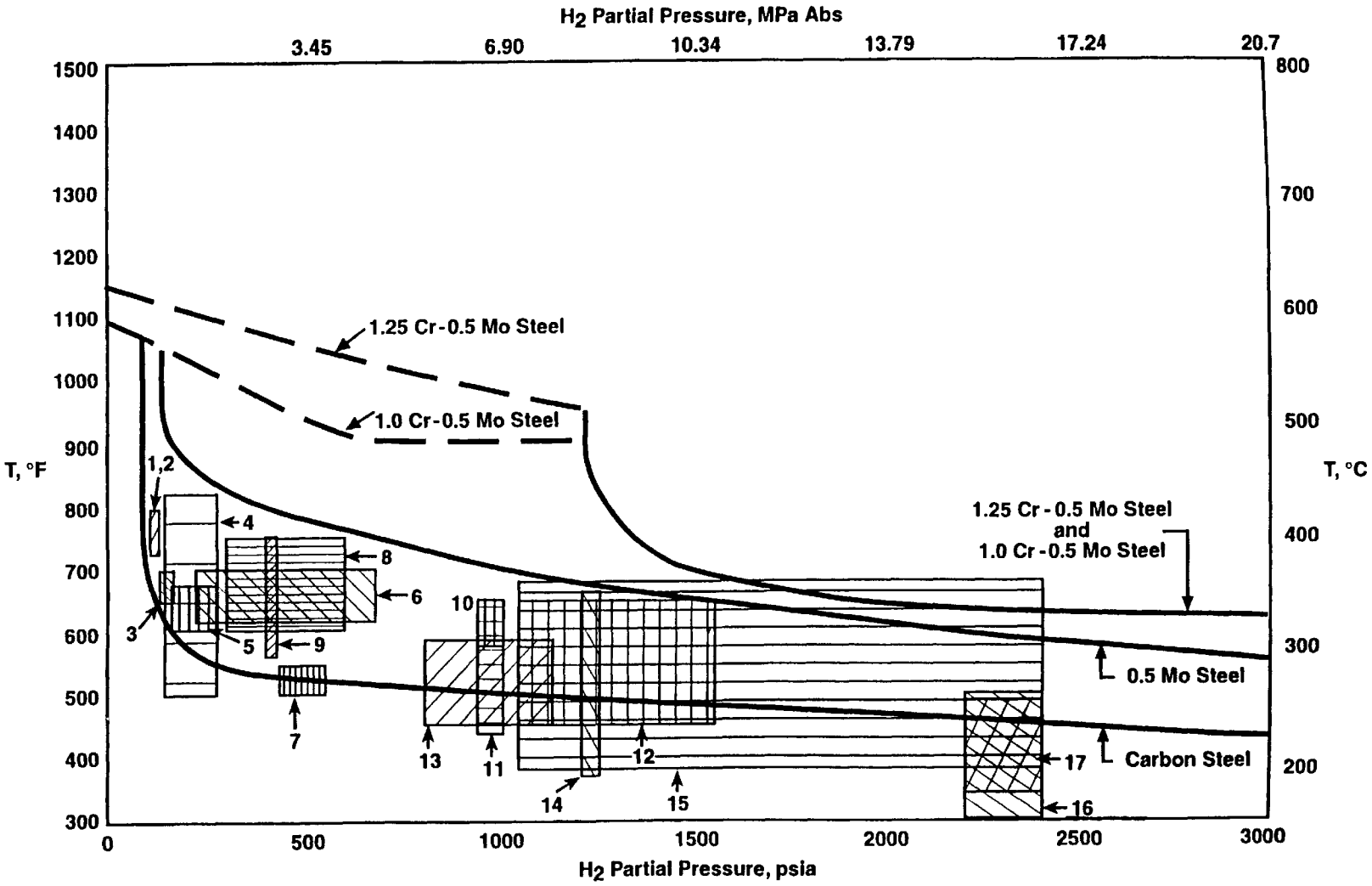
FIG. 1 shows curves defining temperature and pressure ranges where hydrogen attack occurs. Operating conditions where C-0.5 Mo steels have been employed in various refining and petrochemical processes are superimposed on these curves.

Carbon is added to mild steels to impart strength. Hydrogen attack is a high temperature reaction that occurs between hydrogen and the added carbon in carbon and low-alloy steels. This carbon is believed to exist as iron carbides (e.g., $Fe_3C$) or dissolved carbon. At elevated temperature (above about 400° F.) and at hydrogen (partial) pressures above about 100 psig, this carbon somehow reacts with hydrogen (atoms) to produce methane and elemental iron. Reaction of the carbides along with evolution of methane leaves void spaces and bubbles in the steel, thereby weakening it. Tensile strength, creep strength, ductility, and fracture toughness are all reduced. One object of the present invention is to prevent or reduce the rate of hydrogen attack.

In one broad aspect, the present invention is a process which comprises forming an intermetallic, barrier layer on a carbon or low-alloy steel so as to reduce or prevent hydrogen attack. In a preferred embodiment, the barrier layer is formed by contacting a metal-containing paint, preferably a reducible paint (such as a tin paint) with a hydrogen-containing stream at temperatures and flow rates effective for converting the paint to an intermetallic barrier layer.

The diffusion barrier layer of this invention effectively protects the steel from hydrogen attack. An effective barrier layer reduces the rate of hydrogen diffusion through the steel by a factor of 10 or more compared to the uncoated steel, preferably by a factor of 20 or more, and more preferably by a factor of 100 or more. The effectiveness of the barrier layer will vary with the temperature and hydrogen pressure. Simple test procedures, such as those described in the examples below, can be used to determined if the diffusion barrier layer effectively protects the steel from hydrogen attack under specific processing conditions.

Although the terms "comprises" or "comprising" are used throughout this specification, these terms are intended to encompass both the terms "consisting essentially of", and "consisting of" in various preferred aspects and embodiments of the present invention.

As used herein, the term "reactor system" is intended to include any equipment that is subject to hydrogen attack conditions. In a preferred embodiment this equipment comprises one or more hydrocarbon conversion reactors, their associated piping, heat exchangers, furnace tubes, etc.

As used herein, the term "metal-containing coating" or "coating" is intended to include claddings, platings, paints and other coatings which contain either elemental metals, metal oxides, organometallic compounds, metal alloys, mixtures of these components and the like. The metal(s) or metal compounds are preferably a key component(s) of the coating.

As used herein the term "high pressure" encompasses hydrogen partial pressures greater than 400 psig, preferably greater than 600 psig. For a number of important petroleum processes, hydrogen attack is observed at high hydrogen pressures, including pressures greater than 1500 psig As used herein, the term "intermetallic" layer encompasses mixtures of zero valent iron with other zero valent metals. Preferred mixtures include iron stannides (Fe/Sn); iron germanides (Fe/Ge); and iron antimonides (Fe/Sb). The ratio of metals in the intermetallic layer varies depending on the metal and the way the intermetallic layer is prepared. Preferred Intermetallic layers have iron to metal ratios between 0.1 and 100, more preferably between 0.3 and 4.

Figure 2:
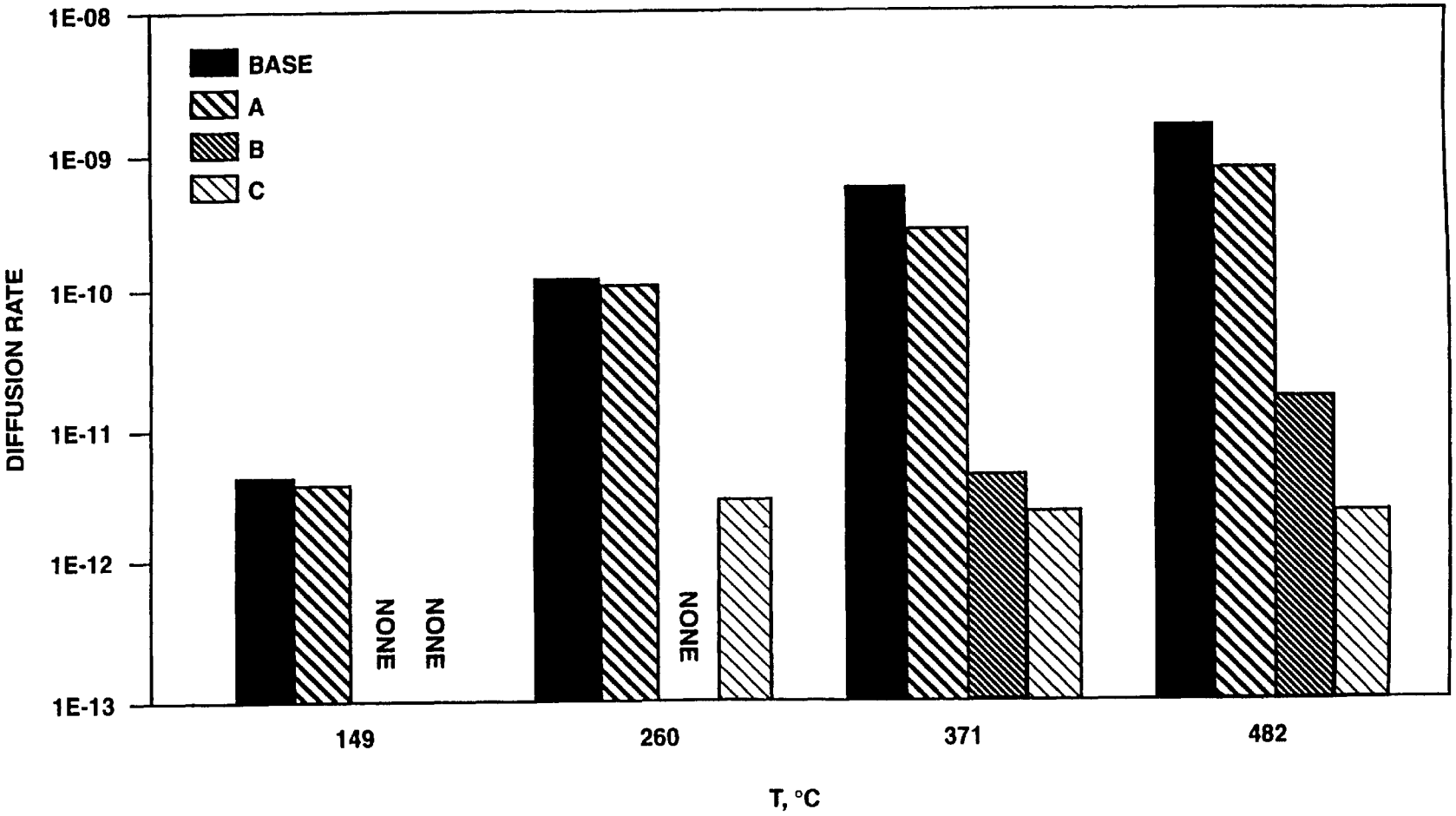
FIG. 2 shows test results comparing the hydrogen diffusion rates (in moles/sec/cm$^2$) of three test specimens, compared to a C-0.5 Mo (base) steel. Tests were run at 250 psig hydrogen pressure and at four temperatures. Specimen A had a copper coating; Specimen B comprised a tin intermetallic; Sample C was a pure copper tube.
Figure 3:
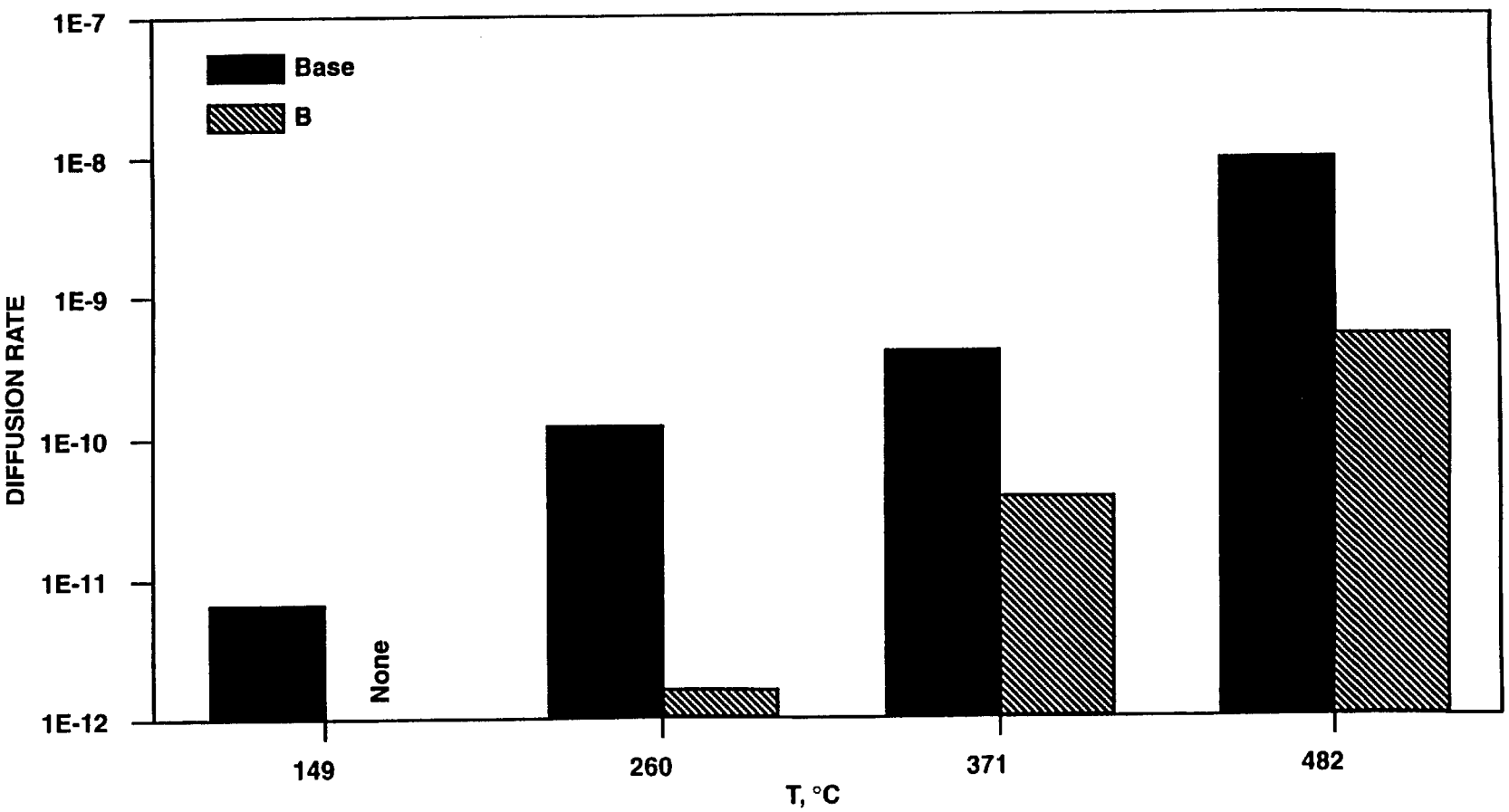
FIG. 3 shows test results comparing the hydrogen diffusion rates (in moles/sec/cm$^2$) at 2000 psig hydrogen partial pressure. In this test, a specimen comprising a tin intermetallic was compared to the C-0.5 Mo steel specimen at four temperatures.

The results from some experiments on hydrogen permeation are summarized in FIGS. 2 and 3. FIG. 2 compares an uncoated C-0.5 Mo steel (baseline), with a copper coated steel (A), a stannided steel (B), and a pure copper tube (C). At 250 psig hydrogen, the stannided steel effectively protected against hydrogen attack; it reduced the rate of hydrogen permeation by a factor of more than 100 compared to the uncoated steel. Note that at the lower temperatures there was no measurable diffusion ("[NONE]") for some of these specimens. Although the pure copper tube was also effective, the copper coated tube was not. FIG. 3 shows that at 2000 psig hydrogen, the tin intermetallic reduced the rate of hydrogen permeation through the steel by a factor of 10 or more compared to the base steel. These experiments are further described hereinbelow.

Steels

Hydrogen attack occurs in carbon and low-alloy steels in which iron carbides are subject to degradation by high-pressure hydrogen. Once these carbides are degraded, the strength and ductility of the steel are reduced. In other types of steel, chromium combines with the carbon to form stable chromium carbides which are not attacked by hydrogen.

As used herein, the term "carbon steels" is intended to include steels which contain carbon (typically less than 1 wt %) as the main strengthening element, up to 1.65 wt % manganese, up to 0.6 wt % silicon, and up to 0.6 wt % copper. Elements such as chromium and molybdenum are not purposely added to these steels. Examples of carbon steels include steel plate meeting ASTM Standard A 516, and steel pipe meeting ASTM Standard A 106.

As used herein, the term "low-alloy steel" is intended to include steels which contain carbon and to which chromium (up to about 3 wt %) and/or molybdenum (up to about 1 wt %) have been purposely added to improve mechanical properties and hydrogen attack resistance. Examples of low-alloy steels include steel plate meeting ASTM Standard A 204 or A 387 (Grades 2, 11, 12, 21 and 22), and steel pipe meting ASTM Standard A 335 (Grades P1, P2, P11, P12, P21 and P22). These steels include but are not limited to C-0.5 Mo steel, 1.0 Cr-0.5 Mo steel, 1.25 Cr-0.5 Mo steel, 2.25 Cr-1.0 Mo steel, and 3.0 Cr-1.0 Mo steel.

The invention is especially applicable to carbon and C-0.5 Mo steel.

Equipment and Process Applications

There are numerous refinery and chemical processes where hydrogen attack is a concern. A representative sampling is shown in Table 1, below. In particular, sections of equipment made of carbon and low-alloy steels may be at risk for hydrogen attack and are continually monitored and inspected to ensure steel integrity. This equipment includes, for example, sections of hydrotreaters, hydrocrackers, hydrofiners and hydrogen plants made of these steels.

FIG. 1 shows process conditions from Table 1 overlaid on standard "Nelson" curves. "Nelson" curves for various steels are published in American Petroleum Institute Publication 941 (API 941), titled "Steels for Hydrogen Service at Elevated Temperatures and Pressures in Petroleum Refineries and Petrochemical Plants". As can be seen from Table 1 and from FIG. 1, high temperature hydrogen attack can occur over a variety of conditions. Generally temperatures are above 400° F. and hydrogen partial pressures are at least 100 psig. In refineries and chemical plants, carbon and low-alloy steel process equipment is typically operated at temperatures between 200 and 845° F., generally between 400 and 820° F. as shown on the Table 1. Usually, carbon steel process equipment is operated at lower temperatures than C-0.5 Mo steel. This equipment includes conversion reactors (reactor hot loops), heat exchangers, gas/liquid separators, steam generators, and associated piping as shown above.

Hydrogen attack is not a concern in the hotter sections of most reactor systems. Those sections operated at 850° F. and higher are designed using higher alloy or special steels. Equipment made of carbon and C-½ Mo steels is designed to operate in the lower temperature environments described above.

Process conditions for hydrogen attack are very different from those where carburization of the steel occurs. For example, unlike the low sulfur reforming conditions of Heyse et al. in WO 92/15653, this invention is not limited to or even related to the sulfur level of the feed. For many of the processes where hydrogen attack is a concern, sulfur levels are well above 0.1 ppm, generally above 0.2 ppm, and often above 0.5 ppm. For example, sulfur levels in desulfurizers and hydrofiners are generally between 1 and 500 ppm, and sometimes much higher. Sulfur levels can be as high as 500, 1000 or 5000 ppm, depending on the process.

TABLE 1

Sample Operating Conditions for Equipment Potentially Susceptible to High-Temperature Hydrogen Attack

| | | | Typical $H_2$ pp | T(° F.) of C-0.5 Mo Equipment | Max. T(° F.) in Plant |
|---|---|---|---|---|---|
| | Up to 999 psig Hydrogen | | | | |
| 1 | Steam Naphtha Reformer | Shift Convertors, Steam Generator | 120–130 | 750–800 | 1520 |
| 2 | Steam Methane Reformer | Shift Reactors, Heat Exchangers | 120–130 | 730–800 | 1560 |
| 3 | Residuum Desulfurizer | Hot Low Pressure Separator | 150–170 | 650–700 | 740 |
| 4 | Hydrogen Manufacturing Plant | Shift Converters, Heat Exchangers | 150–285 | 500–820 | 1525 |
| 5 | Catalytic Reformers | Reactor Hot Loop | 170–280 | 600–680 | 1050 |
| 6 | Naphtha Hydrotreater | Reactor Hot Loop | 220–675 | 625–700 | 700 |
| 7 | Fluid Cat. Cracker Hydrofiner | Feed/Efftuent Heat Exchangers | 430–550 | 500–550 | 700 |
| 8 | Diesel Furnace Hydrofiner | Reactar Heat Loop | 300–600 | 600–750 | 750 |
| 9 | Jet Hydrotreater | Feed/Effluent Heat Exchangers | 410–425 | 570–750 | 750 |
| | 1000–1999 psig Hydrogen | | | | |
| 10 | Steam Methane Reformer | Feed/Effluent Heat Exchangers | 950–1000 | 570–650 | 1560 |
| 11 | Vacuum Gas Oil Hydrotreater | Feed/Effluent Heat Exchangers | 950–1000 | 440–650 | 735 |
| 12 | Isomax Cracking Unit | Feed/Effluent Heat Exchangers | 1050–1550 | 450–650 | 825 |
| 13 | Diesel Hydrofiner | Reactors, High-Pressure Separator | 800–1120 | 450–580 | 580 |
| 14 | Jet Hydrogenation Plant | Reactor Hot Loop | 1200–1250 | 360–660 | 660 |
| | Over 2000 psig Hydrogen | | | | |
| 15 | Hydrocrackers | Reactor Hot Loop, High–Pressure Separators, Steam Generator | 1050–2400 | 380–675 | 825 |
| 16 | Lube Oil Hydrofiners | Feed/Effluent Heat Exchangers | 2200–2400 | 200–500 | 765 |
| 17 | Lube Oil Hydrocrackers | Heat Exchangers | 2200–2400 | 340–485 | 810 |

The preferred intermetallic depends the amount of sulfur in the hydrogen-containing stream. It is preferred to use tin intermetallics at the lower sulfur levels (below about 500 ppm S). Either antimony or germanium intermetallics are preferred at sulfur levels above about 500 ppm S.

The following table shows tests results comparing hydrogen diffusion rates for various screening specimens. For details, see Examples 1 and 2 below. Low diffusion rates (below $100\times10^{-12}$ moles/sec/cm$^2$, preferably below $50\times10^{-12}$ and more preferably below $20\times10^{-12}$ at 250 psig and 900° F.) indicate diffusion barrier layers that are effective in protecting against hydrogen attack. As can be seen, the stannided specimen was very effective.

TABLE 2

Diffusion Rates [1]

| Specimen | $H_2$ Diffusion Rate, $10^{-12}$ moles/sec/cm$^2$ |
|---|---|
| Pure copper | 2 |
| Base C-0.5 Mo steel | 1390 |
| HVOF Cu coating | 703 |
| TWA Cu coating | 1040 |
| TWA Ni coating | 1110 |
| Stannided (Tin painted) | 15 |

[1] 250 psig at 900° F.;
HVOF = High-velocity oxygen fuel sprayed;
TWA = Twin wire arc deposited This invention is especially applicable to retrofit situations. Here, steel that has already been in contact with high temperature hydrogen (e.g., at temperatures greater than 400° F. and hydrogen pressures greater than 100 psig) is treated to minimize or prevent hydrogen attack, and is thereby economically upgraded. The invention is also applicable to new equipment, for example where equipment designed and purchased for one use is brought into service for a different use.

Additionally, after providing an intermetallic, diffusion barrier layer to a carbon or low-alloy steel portion of a reactor system, it is believed that the pressure and/or the operating temperature can be increased. The intermetallic, diffusion barrier layer should allow the equipment to operate at increased severity.

The diffusion barrier layer is prepared on the hydrogen side of the equipment. The coating may be applied to the inside, outside or both sides of a vessel or pipe. Where the barrier layer is applied depends on the process configuration and hazards associated with hydrogen diffusion through the metallurgy as will be appreciated by those skilled in the art.

Coatings and Preparing Barrier Layers

The intermetallic, surface diffusion barrier layer of this invention comprises a continuous and uninterrupted intermetallic layer. A variety of coating materials may be used to prepare the intermetallic, diffusion barrier layer. In a preferred embodiment the coatings are reduced to produce reactive metal that interacts with the steel to form an intermetallic layer. Preferred coating metals include tin, antimony, and germanium. Examples of tin, antimony, and germanium materials that may be used to prepare the intermetallic layer include metal powders (such as metallic tin powder), metal oxides, metal sulfides, metal hydrides, metal halides and organometallic compounds. Preferred materials include metallic tin powder, tin oxide, tin sulfide, tin organometallic compounds, metallic antimony, antimony compounds, antimony organometallic compounds, metallic germanium, germanium compounds and germanium organometallic compounds. An especially preferred coating comprises metallic tin, or tin compounds.

Metal-containing coatings can be applied in a variety of ways, which are well known in the art, such as electroplating, chemical vapor deposition, and sputtering, to name just a few. Preferred methods of applying coatings include painting and plating. Where practical, it is preferred that the coating be applied in a paint-like formulation (hereinafter "paint"). Such a paint can be sprayed, brushed, pigged, etc. on reactor system surfaces.

One preferred diffusion barrier layer is prepared from a metal-containing paint. Preferably, the paint is a decomposable, reactive, metal-containing paint which produces a reactive metal which interacts with the steel. Tin is a preferred metal and is exemplified herein; disclosures herein about tin are generally applicable to antimony and germanium. Preferred paints comprise a metal component selected from the group consisting of: a hydrogen decomposable metal compound (such as an organometallic compound), finely divided metal and a metal oxide, preferably a reducible metal oxide.

The surface diffusion barrier layer can be obtained using a variety of processes. For example, a tin paint (such as described in WO 92/15653) can be applied to the inside surface of a carbon or low-alloy steel pipe that has been previously contacted with high pressure hydrogen. It can be cured in-situ at about 1000° F., for example, using low or high pressure hydrogen. After curing the steel has an intermetallic tin surface barrier layer that protects the steel against hydrogen attack.

For tin, it is preferred to pre-form an iron-stannide layer on the steel, prior to subjecting the steel to hydrogen attack conditions. This may be done, for example, by heating at 700–1300° F. in hydrogen, preferably by heating at 900–1100° F.

Some preferred coatings and paint formulations are described in WO 92/15653 to Heyse et al. Flowable paints that can be sprayed or brushed are preferred. One especially preferred tin paint composition contains at least four components or their functional equivalents: (I) a hydrogen decomposable tin compound, (ii) a solvent system, (iii) finely divided tin metal and (iv) tin oxide. As the hydrogen decomposable tin compound, organometallic compounds such as tin octanoate or neodecanoate are particularly useful. Component (iv), the tin oxide is a porous tin-containing compound which can sponge-up the organometallic tin compound, and can be reduced to metallic tin. The paints preferably contain finely divided solids to minimize settling. Finely divided tin metal, component (iii) above, is also added to insure that metallic tin is available to react with the surface to be coated at as low a temperature as possible. The particle size of the tin is preferably small, for example one to five microns. Tin forms intermetallic stannides (e.g., iron stannides and nickel/iron stannides) when heated in streams containing hydrogen and hydrocarbons.

In one embodiment, there can be used a tin paint containing stannic oxide, tin metal powder, isopropyl alcohol and 20% Tin Ten-Cem (manufactured by Mooney Chemical Inc., Cleveland, Ohio). Twenty percent Tin Ten-Cem contains 20% tin as stannous octanoate in octanoic acid or stannous neodecanoate in neodecanoic acid. When tin paints are applied at appropriate thicknesses, typical reactor start-up conditions will result in tin migrating to cover small regions (e.g., welds) which were not painted. This will completely coat the base metal.

It is preferred that the coatings be sufficiently thick that they completely cover the base metallurgy and that the resulting barrier layers remain intact over years of operation. This thickness depends on the intended use conditions and the coating metal. For example, tin paints may be applied to a (wet) thickness of between 1 to 6 mils, preferably between about 2 to 4 mils. In general, the thickness after curing is preferably between about 0.1 to 50 mils, more preferably between about 0.5 to 10 mils, and most preferably between about 0.5 to 2 mils. Thin barrier layers are preferred since they are more compliant with the substrate and thus reduce the risk of thermal-mechanical cracking or spalling.

Coated materials are preferably cured in a hydrogen-containing atmosphere at elevated temperatures. Cure conditions depend on the coating metal and are selected so they produce a continuous and uninterrupted diffusion barrier layer which adheres to the steel substrate. Hydrogen contacting preferably occurs while the diffusion barrier layer is being formed. The resulting diffusion barrier layer is able to withstand repeated temperature cycling, and does not degrade in the reaction environment. Preferred diffusion barrier layers are also useful in oxidizing environments, such as those associated with coke burn-off.

Cure conditions depend on the particular metal coating as well as the process conditions where the barrier layer is to be used. For example, gas flow rates and contacting time depend on the cure temperature, the coating metal and the components of the coating composition. Cure conditions are selected so as to produce an adherent diffusion barrier layer. In general, the contacting of the reactor system having a metal-containing coating, plating, cladding, paint or other coating applied to a portion thereof with hydrogen is done for a time and at a temperature sufficient to produce an intermetallic diffusion barrier layer. These conditions may be readily determined. For example, coated coupons may be heated in the presence of hydrogen in a simple test apparatus; the formation of the diffusion barrier layer may be determined using petrographic analysis.

The curing can be done prior to subjecting the apparatus to hydrogen attack environment or during start-up of the process. The primary requirement is that reaction conditions are sufficient to convert the coating to a continuous and adherent intermetallic diffusion barrier layer. It is preferred to cure prior to start-up, since mobile metals can potentially poison catalysts and the equipment is may not be rated for use at cure temperatures with hydrogen pressures greater than 100 psi.

It is preferred that cure conditions result in a diffusion barrier layer that is firmly bonded to the steel. This may be accomplished, for example, by curing the applied coating at elevated temperatures. Metal or metal compounds contained in the paint, plating, cladding or other coating are preferably cured under conditions effective to produce molten or mobile metals and/or compounds. Tin paints are preferably cured between 900 and 1100° F. Germanium and antimony paints are preferably cured between 1000 and 1400° F. Metallic antimony may be cured between 1300 and 1400° F., SbS between 900 and 1000° F. Curing is preferably done over a period of hours, often with temperatures increasing over time. The presence of hydrogen is especially advantageous when the paint contains reducible metal oxides and/or oxygen-containing organometallic compounds.

As an example of a suitable paint cure for a tin paint, the system including painted portions can be pressurized with flowing nitrogen, followed by the addition of a hydrogen-containing stream. The steel temperature can be raised to 800° F. at a rate of 50–100° F./hr. Thereafter the temperature can be raised to a level of 950–975° F. at a rate of 50° F./hr, and held within that range for about 48 hours.

To obtain a more complete understanding of the present invention, the following examples illustrating certain aspects of the invention are set forth. It should be understood, however, that the invention is not intended to be limited in any way to the specific details of the examples.

EXAMPLE 1

Preparation of Coated Samples for Screening

The following materials were evaluated for hydrogen permeation. They are described below.

TABLE 3

| Screening Test Materials | |
|---|---|
| Base | Bare C-0.5 Mo steel |
| AB | HVOF Cu-coated C-0.5 Mo steel |
| C | Stannided C-0.5 Mo steel |
| DE | Pure Cu tube |
| | TWA Cu-coated C-0.5 Mo steel |
| | TWA Ni-coated C-0.5 Mo steel |

C-0.5 Mo Plate Steel (Baseline)

The C-0.5 Mo plate steel (one inch thick) used in these tests met the specifications of ASTM A204-90 Grade B. Its mechanical properties included: Yield Strength, 61.0 ksi; Tensile Strength, 87.0 ksi; Elongation, 24.0% and Reduction in Area, 60.0%.

The chemical composition of the steel included by weight: C, 0.18%; Mn, 0.75%; S, 0.027%; P, 0.014%; Si, 0.20%; Cr, 0.18%; Ni, 0.29%; Mo, 0.54%; Cu, 0.12%; V, 0.02%; Al, 0.02%; and Cb (niobium), 0.06%. The microstructure consisted of pearlite in a ferrite matrix. An as-rolled steel high in sulfur and phosphorus with little to no carbide stabilizing elements was selected so that a reasonable worst case susceptibility to high-temperature hydrogen attack could be observed.

Copper and Nickel Coated Materials (A, D, E)

Coated test specimens included high-velocity, oxygen fuel sprayed copper (HVOF Cu, Specimen A), twin wire arc-deposited copper (TWA Cu, Specimen D), twin wire arc-deposited nickel (TWA Ni, Specimen E), all on C-0.5 Mo steel. The twin wire arc coatings were deposited to a thickness of 0.015 inch to 0.020 inch, and the high-velocity, oxygen fuel sprayed coating was deposited to a thickness of 0.040 inch to 0.045 inch. With these specimens, the effectiveness of the two coating methods could be compared (TWA Cu versus HVOF Cu) and the effectiveness of a copper coating versus a nickel coating could also be compared (TWA Cu versus TWA Ni).

Stannided Materials (B)

Stannided specimens (Specimen B) were prepared by painting the outside of the C-0.5 Mo steel with a tin-containing paint. The paint consisted of a mixture of 2 parts powdered tin oxide, 2 parts finely powdered tin (1–5 microns), 1 part stannous neodecanoate in neodecanoic acid (20% Tin Tem-Cem sold by Mooney Chemical Company) mixed with isopropanol, as described in WO 92/15653 to Heyse et al. The painted specimen was heated in a hydrogen/nitrogen atmosphere at 1100° F. for 24 hours. A continuous and adherent intermetallic (iron stannide) layer having a thickness of about 30 microns was produced on the steel surface.

99.99 Percent Pure Cu Material

The Cu material used in these tests was 99.99 percent pure and met the specifications of ASTM B170, Grade 1. The material was hard regular oxygen-free grade, in round bar form prior to machining into test specimens. The build-up of hydrogen pressure on the tube inner diameter was monitored. Using the tube volume, the number of moles of hydrogen which permeated through the tube from the outside was calculated from the idea gas law equation.

EXAMPLE 2

Preliminary Screening Tests

The specimens of Examples 1A–E were tested for hydrogen permeation and compared to the baseline C-0.5 Mo steel. The following experiments—which show comparisons between tin, copper and nickel—demonstrate the nonobviousness and lack of predictability of this invention.

The test apparatus consisted of a autoclave into which high-pressure hydrogen (up to 2000 psig) was introduced. Hydrogen permeation rates were determined by exposing a secured closed-end tube (test specimen) to a combination of externally applied hydrogen pressure and temperature.

A threaded stainless steel plug was welded on one end of the test specimens, and screwed onto a threaded stud at the bottom of the autoclave. This fixed the test specimen in place. The opposite end of the test specimen exited the autoclave cover through an annulus. A pressure transducer was installed on this specimen end.

Inside the autoclave, a cylindrical heater was placed around the test specimen. The heater allowed the specimen to be heated to test temperature (300°–900° F.). After installation of the heater, the autoclave was sealed and filled with hydrogen. The hydrogen contacted the specimen OD, which was either coated with a candidate coating, or was left bare. Power leads for the cylindrical heater exited the autoclave cover.

Once the specimen was heated, hydrogen on the specimen OD could diffuse into and permeate the specimen wall. Permeated hydrogen which reached the tube ID then built up inside the tube. The volume on the tube ID was fixed at 0.8 cu. in. by inserting a solid stainless steel filler bar. This filler bar reduced the volume within the C-0.5 Mo specimen tube (which allowed faster pressure build-up), and fixed the volume so that the amount of permeated hydrogen could be calculated. The filler bar consisted of two separate solid bar sections connected by a stainless steel stud. A ¼ gap between the two solid filler bar sections provided most of the available volume on the C-0.5 Mo tube ID.

The amount of built-up hydrogen on the tube ID was determined using the pressure transducer. Using the measured gas pressure (from the transducer), the known test temperature, and the known volume within the specimen tube (due to the filler bar configuration), the number of moles of hydrogen which had permeated the tube wall was calculated.

The C-0.5 Mo steel specimens used in the test were fabricated by machining a hollow C-0.5 Mo tube from plate material aligned parallel with the rolling direction. The tube was then welded to a solid Type 316 stainless steel plug on one end, and a thicker-walled Type 316 stainless steel tube on the other end. Since hydrogen permeation through Type 316 stainless is orders of magnitude less than through C-0.5 Mo steel, this configuration ensure that the hydrogen which permeated to the tube ID entered through the C-0.5 Mo steel. The relatively thin 0.0625 inch (1.6 mm) wall thickness of the C-0.5 Mo steel compared to the adjacent and thicker Type 316 stainless steel tube section, guaranteed that permeation through the stainless steel was minimal compared to that through the C-0.5 Mo steel. Additionally, heat was only applied to the C-0.5 Mo steel portion. Since the temperature of the adjoining stainless steel tube was lower, its hydrogen permeation rate was further reduced.

The coated test specimens were prepared from the C-0.5 Mo steel hollow tube specimens described above. They were coated on the outside of the C-0.5 Mo portion, after welding of the stainless steel portions onto the ends of the C-0.5 Mo portion.

Since the permeation rate of hydrogen through copper is less than that through stainless steel, a different specimen tube configuration was used for the permeation tests with copper. In this case, the entire copper tube specimen was fabricated from pure copper bar material. A stainless steel filler bar was still inserted into the copper test specimens in order to reduce and fix the volume within the specimen tube.

The build-up of hydrogen pressure on the tube inner diameter was monitored for each specimen at various hydrogen pressures. Using the tube volume, the number of moles of hydrogen which permeated through the tube from the outside, the permeation rate was calculated using the ideal gas law equation.

The materials shown in Table 3 were screened in the hydrogen permeation tests at 250 psig hydrogen at 900° F. This condition falls above the Nelson curve for C-0.5 Mo material (see FIG. 1), and thus is a condition which causes high-temperature hydrogen attack in the bare baseline (C-0.5 Mo) steel. The amount of permeated hydrogen was recorded for each specimen. Each permeation test lasted 500 hours and included duplicate specimens for each of the candidate coating systems and uncoated material. The increase in hydrogen pressure on the tube ID due to permeation through the tube wall was monitored by pulling a vacuum on the tube ID, and sweeping the hydrogen gas through an ionization gauge.

Cool down to room temperature was conducted slowly [approximately 50° C. (80° F.) per hour] to minimize or prevent disbonding of the coatings due to rapid changes in temperature. The samples were inspected microscopically for hydrogen induced fissuring.

The test results are shown in Table 1. As can be seen, the hydrogen permeation rate through the stannided sample is about two orders of magnitude less than through either the bare baseline C-0.5 Mo steel specimen, or any of the other coated steel specimens. Although the solid Cu specimen, shows much lower hydrogen permeation than the bare C-0.5 Mo specimen, the Cu and Ni coatings did not effectively reduce hydrogen permeation. Only the stannided (1B) and pure copper (1C) specimens showed a reduction in permeation rate of an order of magnitude or more compared to the C-0.5 Mo steel. Based on the results of these screening tests, the two Cu and Ni TWA coated specimens (D and E) were excluded from the next round of testing.

EXAMPLE 3

Testing the Most Promising Candidates

Following the screening tests of Example 2 (at 900° F.) similar experiments were done comparing with the three most promising candidates (material A–C) against the C-0.5 Mo at 300° F., 500° F., and 700° F. at 250 psig hydrogen pressure. These results are shown in Table 2. Low diffusion rates [below $100\times10^{-12}$ moles/sec/cm$^2$ and preferably as low as $10\times10^{-12}$ at 250 psig and 900° F.] indicate barrier layers that will effectively prevent hydrogen attack.

EXAMPLE 4

High-Pressure Testing

A tin-coated specimen was cured to produce a stannide intermetallic layer It was subjected to 2000 psig hydrogen pressure at 300° F., 500° F., 700° F., and 900° F. to see if the stannide layer reduces hydrogen permeation at this high hydrogen pressure. FIG. 3 shows that hydrogen permeation through a stannided C-0.5 Mo steel specimen was one or more orders of magnitude less than through a bare baseline specimen. This example shows that the tin intermetallic layer prevents hydrogen permeation at high hydrogen pressures over a wide temperature range.

EXAMPLE 5

Stanniding a Piece of Pipe

The inside of a 6" O.D., 0.280" wall thickness, 1½ foot section of 1.25 Cr-0.5 Mo pipe was coated with the tin paint described in Example 1. It was cured in a mixture of hydrogen and nitrogen at 1100° F. for about 24 hours, resulting in a continuous and adherent stannide intermetallic layer. Before coating a connector for a hydrogen patch probe was welded on the O.D. of the pipe.

EXAMPLE 6

Comparing Coated and Bare Pipe in a Steam-Naphtha Reformer

A piece of uncoated bare pipe (as in Example 5) was fitted with a hydrogen patch probe on its outer surface. The pressure gauges on this probe and on the probe attached to the piece of pipe from Example 5 allowed hydrogen permeation through the pipe walls to be monitored and compared.

The two pipe sections were welded into a line in a refinery steam-naphtha reformer. The sections were welded adjacent to one another so that the operating conditions in each pipe were approximately the same: 200–350 psig hydrogen partial pressure at 575°–650° F. Hydrogen pressure were recorded over a 20-day period; the results are shown in Table 4.

Despite having the same, or even a slightly more severe environment for hydrogen permeation/attack (due to a slightly higher temperature in the coated piece of pipe), there was no hydrogen permeation through the stannided pipe. In contrast, the pressure in the bare pipe rose during the test.

TABLE 4

| Days in | Bare Pipe | | Stannided Pipe | |
|---|---|---|---|---|
| Test | ° F. | psig | ° F. | psig |
| 0 | 438 | 0 | 514 | 0 |
| 1 | 430 | 0 | 518 | 0 |
| 3 | 564 | 3 | 626 | 0 |
| 6 | 579 | 5.3 | 637 | 0 |
| 9 | 572 | 6.3 | 635 | 0 |
| 10 | 573 | 6.5 | 638 | 0 |
| 14 | 584 | 6.5* | 646 | 0 |
| 15 | 562 | 7.8 | 634 | 0 |
| 16 | 576 | 8.3 | 640 | 0 |
| 17 | 570 | 8.5 | 639 | 0 |
| 20 | 558 | 8.5 | 605 | 0 |

*Gauge pressures were released to test gauge functioning.

This test showed that the intermetallic stannide layer significantly reduced the amount of hydrogen that permeated through the pipe wall. The effectiveness of the tin intermetallic in reducing hydrogen permeation through the 1.25 Cr-0.5 Mo steel indicates that it would also be effective for carbon and other low-alloy steels.

While the invention has been described above in terms of preferred embodiments, it is to be understood that variations and modifications may be used as will be evident and appreciated by those skilled in the art. These variations and modifications are to be considered within the scope of the invention as defined by the following claims.

What is claimed is:

1. A method for protecting carbon and low-alloy steels from high temperature hydrogen attack and fissuring, comprising:

(a) applying a metal plating, paint, cladding or other coating to a steel portion of a reactor system made of carbon or low-alloy steel that has been subjected to hydrogen attack conditions; and (b) forming an intermetallic, diffusion barrier layer on the steel surface by heating; thereby reducing the rate of hydrogen permeation through the steel portion by a factor of at least 10 compared to a steel portion without the barrier layer.

2. The method of claim 1 wherein the intermetallic, diffusion barrier layer is prepared from coatings selected from tin, tin compounds, antimony, antimony compounds, germanium, germanium compounds, and mixtures, alloys, and intermetallic compounds thereof.

3. The method of claim 2 wherein the intermetallic, diffusion barrier layer is prepared from tin, or tin compounds, or tin alloys or intermetallic compounds of tin.

4. The method of claim 3, further comprising pre-forming an iron-stannide layer on said steel, prior to subjecting the steel to hydrogen attack conditions.

5. The method of claim 1 wherein the hydrogen attack conditions comprise a hydrogen pressure of above about 400 psig.

6. The method of claim 1 wherein the thickness of the barrier layer is between 0.5 and 10 mil.

7. The method of claim 1 wherein the steel is carbon steel or C-0.5 Mo Steel.

8. A method of using a carbon or low-alloy steel portion of a reactor system having an intermetallic, diffusion barrier layer thereon, comprising the steps of providing a reactor system comprising carbon or low-alloy steel portions having an intermetallic, diffusion barrier layer thereon; and contacting said portions with a hydrogen-containing gas at hydrogen attack conditions comprising a temperature between 400° F. to 1050° F. and a hydrogen partial pressure above 400 psig, wherein said steel portions are protected against hydrogen attack and fissuring by said intermetallic, diffusion barrier layer.

9. The method of claim 8 wherein the intermetallic, diffusion barrier layer reduces the rate of hydrogen permeation through the steel by a factor of at least 10.

10. The method of claim 8 or 9 wherein the intermetallic, diffusion barrier layer is prepared from coatings selected from tin, tin compounds, antimony, antimony compounds, germanium, germanium compounds, and mixtures, alloys, and intermetallic compounds thereof.

11. The method of claim 8 or 9 wherein the intermetallic, diffusion barrier layer is prepared from tin, or tin compounds, or tin alloys or intermetallic compounds of tin.

12. The method of claim 8 or 9, further comprising pre-forming an iron-stannide layer on said steel, prior to subjecting the steel to hydrogen attack conditions.

13. The method of claim 8 or 9 wherein the thickness of the barrier layer is between 0.5 and 10 mil.

14. The method of claim 8 or 9 wherein the reactor system has already been contacted with hydrogen at temperatures greater than 400 ° F. and pressures greater than 100 psig prior to forming the barrier layer.

15. The method of claim 8 or 9 wherein the steel is carbon steel or C-0.5 Mo steel.

16. The method of claim 8 or 9 wherein the intermetallic layer comprises antimony or germanium, and the hydrogen-containing gas comprises greater than 10 ppm sulfur.

17. The method of claim 8 or 9 wherein the hydrogen pressure is above about 600 psig.

* * * * *